US009433820B1

(12) United States Patent
Martinez

(10) Patent No.: US 9,433,820 B1
(45) Date of Patent: Sep. 6, 2016

(54) BIKE ROLLER SYSTEMS

(71) Applicant: Francisco Martinez, Ridgefield, NJ (US)

(72) Inventor: Francisco Martinez, Ridgefield, NJ (US)

( * ) Notice: Subject to any disclaimer, the term of this patent is extended or adjusted under 35 U.S.C. 154(b) by 278 days.

(21) Appl. No.: 14/298,211

(22) Filed: Jun. 6, 2014

Related U.S. Application Data

(60) Provisional application No. 61/832,077, filed on Jun. 6, 2013.

(51) Int. Cl.
*A63B 21/00* (2006.01)
*A63B 22/06* (2006.01)

(52) U.S. Cl.
CPC ..... *A63B 22/0605* (2013.01)

(58) Field of Classification Search
CPC ..... A63B 21/00
USPC ..... 482/87, 51
See application file for complete search history.

(56) References Cited

U.S. PATENT DOCUMENTS

| | | | | |
|---|---|---|---|---|
| 2,261,846 | A | 3/1941 | Dollinger | |
| 5,145,478 | A | 9/1992 | Minoura | |
| 5,522,781 | A | 6/1996 | Minoura | |
| 7,736,282 | B1 * | 6/2010 | Horowitz ..... | A63B 69/16 482/57 |

* cited by examiner

*Primary Examiner* — Jerome W Donnelly
(74) *Attorney, Agent, or Firm* — RG Patent Consulting, LLC; Rachel Gilboy

(57) ABSTRACT

A bike roller mounting system that renders a normal bicycle stationary for riding, to provide biking enthusiasts and those who exercise with bikes a simple and effective means of riding indoors when weather conditions prohibit enjoyment of the activity outside.

20 Claims, 5 Drawing Sheets

BIKE ROLLER SYSTEMS

CROSS-REFERENCE TO RELATED APPLICATION

The present application is related to and claims priority from prior provisional application Ser. No. 61/832,077, filed Jun. 6, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of stand devices for use with bicycles and more specifically relates to a specially designed mounting system that renders a 'normal' bicycle stationary for riding to provide biking enthusiasts and those who exercise with bikes a simple and effective means of riding indoors when weather conditions prohibit enjoyment of the activity outside.

2. Description of the Related Art

One of the most popular recreational activities enjoyed by Americans is bicycling. According to statistics provided by the National Sporting Goods Association, an estimated 41.4 million people participate in some form of bicycle riding in the United States. A form of relaxation, pedaling slowly down the street can help a rider wind down after a stressful day. On the other hand, many find bicycles to be the perfect instruments of fitness and sport. Providing a healthy, cardiovascular workout as well as a great way to tone one's muscles, riding down bike trails has become a favored form of exercise for those concerned with their physical well being.

Additionally, sports enthusiasts relish the frenetic energy of competitive bicycle races, from local track contests to cross country triathlons. Whether it is to simply relax, get fit, or have fun, bicycling provides riders with an enjoyable way to experience the outdoors. For those who want to ride on a daily basis, however, inclement weather conditions can make such an endeavor impossible. Whether torrential rains ruin the day, trails and roads are covered with falling snow, or the sun is relentlessly beating down, the elements often dictate when and where one can ride a bicycle. As can be imagined, a planned nature ride or a fitness regimen interrupted by weather is a frustrating challenge for the bike enthusiast. A solution is desirable.

Various attempts have been made to solve the above-mentioned problems such as those found in U.S. Pat. No. 2,261,846 to Lewis L. Dollinger et al; U.S. Pat. No. 5,522,781 to Koji Minoura; and U.S. Pat. No. 5,145,478 to Chihiro Minoura. This art is representative of stand devices. None of the above inventions and patents, taken either singly or in combination, is seen to describe the invention as claimed.

Ideally, a stand device should provide ease of use and, yet would operate reliably and be manufactured at a modest expense. Thus, a need exists for a reliable bike roller system to render a normal bicycle stationary for riding, and provide biking enthusiasts and those who exercise with bikes a simple and effective means of riding indoors and to avoid the above-mentioned problems.

BRIEF SUMMARY OF THE INVENTION

In view of the foregoing disadvantages inherent in the known stand device art, the present invention provides a novel bike roller system. The general purpose of the present invention, which will be described subsequently in greater detail, is to provide a mounting system that renders a normal bicycle stationary for riding to provide biking enthusiasts and those who exercise with bikes a simple and effective means of riding indoors when weather conditions prohibit enjoyment of the activity outside.

A bike roller system is disclosed herein, in a preferred embodiment, comprising: a bike roller assembly having a base plate and a first side having an extendable bar, a second side, a third side, a fourth side, and an inner volume. It further comprises a top side having a plurality of horizontal roller assemblies, a plurality of vertical rotators, a plurality of mount rods, and a bottom side. The bike roller assembly may be made of aluminum which is a sufficiently light, durable material allowing it to be easily transportable for use as desired. The bike roller assembly renders a normal bicycle stationary, and able to be utilized indoors to avoid existing outside weather conditions.

The mount system allows a (normal-conventional) bicycle to be free standing and secure for use as needed, and will accommodate virtually any model of bicycle. It allows a user to pedal a normal bicycle at a desired speed, yet remain stationary, thus the bike being multi-functional in use and application. The base plate comprises a substantially flat plate to allow the bike roller assembly to be set on a flat surface, and measures approximately twenty four inches in length by eighteen inches in width for increased operational stability. It is approximately one inch in depth to allow the extendable bar to be stored therein. The extendable bar extends outwardly from the base plate, and alternately retracts back into the base plate for storage when not in use. It can be deployed to keep the bicycle front tire from making contact with the surface beneath it, keeping that surface clean.

The top side has a plurality of horizontal roller assemblies, a plurality of vertical rotators, and a plurality of mount rods mounted thereon. The plurality of horizontal rollers are evenly spaced apart in a parallel fashion, and a rear bicycle tire sits directly on the plurality of horizontal roller assemblies when a bike is mounted to the bike roller assembly. The plurality of horizontal rollers are configured to freely rotate three hundred sixty degrees, such that a rear bicycle tire is allowed to rotate in a backward motion or a forward motion, and are adjustable to increase pedal resistance as desired.

The plurality of vertical rotators are mounted upon the top side, and spaced in a manner which allows a rear bicycle tire to be placed in between the plurality of vertical rotators. A rear bicycle tire is vertically fixed between the plurality of vertical rotators for increased stability when in an in-use condition, and are adjustable to accommodate a variety of tire widths for best use. The plurality of vertical rotators acts as a guide for secure placement of a rear bicycle tire while in use.

The plurality of mount rods are affixed to the top side of the base plate to allow mounting of the bike roller assembly to a rear bicycle tire axle. The plurality of mount rods angle towards the center of the base plate to allow ease of mounting a normal bicycle to the bike roller assembly and maintain a low center of gravity. The plurality of mount rods are attached to the rear axle of a normal bicycle for use, and have gussets to increase vertical structural stability.

The present invention holds significant improvements and serves as a bike roller system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, bike roller system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a stand device and more particularly to a bike roller as used to improve the ability of a user to attach a normal bicycle (for use in non-stationary use, yet able to be used in stationary use using the present invention, yet not impairing its use in normal application when not used with the present invention) to the bike roller stand and render it stationary, for riding enthusiasts and those who exercise with bikes a simple and effective means of riding indoors when weather conditions prohibit enjoyment of the activity outside.

Generally speaking, the bike roller system comprises a specially designed mounting system that renders a normal bicycle stationary for riding when desired. In this manner, the product permits bicycle operation indoors, regardless of the weather or time of day. Basically rectangular in shape, the base plate would measure approximately twenty-four inches (24") in length, eighteen inches (18") in width, and one inch (1") in depth. Positioned on the top of this base plate would be two (2) tubular aluminum "rollers," evenly spaced apart in a parallel fashion. Configured to freely rotate three hundred sixty degrees (360°), these heavy duty rollers would serve to allow for backward and forward motion of the rear wheel of a bicycle. The Bike Roller system may also include simple hardware to facilitate security of a bike onto the bike roller assembly, so that the bike is freestanding and secure while the product is in use.

Figure 1:
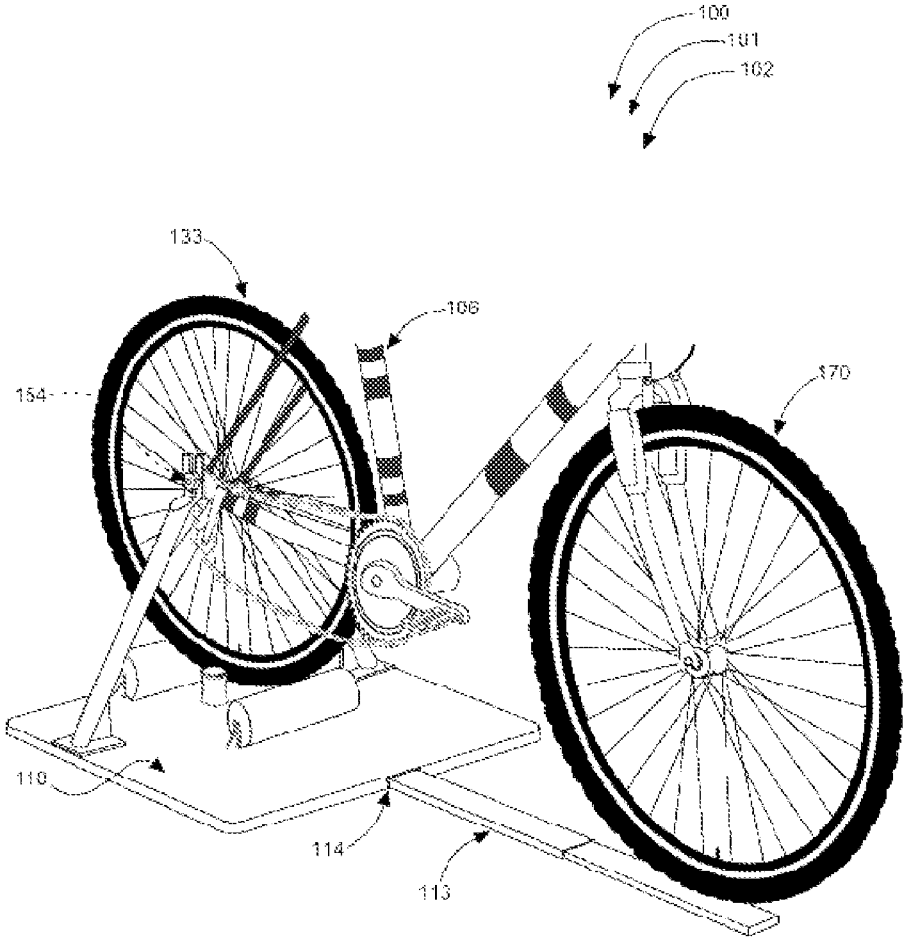
FIG. 1 shows a perspective view illustrating an in-use condition for a bike roller system according to an embodiment of the present invention.

Referring to the drawings by numerals of reference there is shown in FIG. 1, a perspective view illustrating an in-use condition 101 of bike roller system 100 according to an embodiment of the present invention.

Bike roller system 100 in a preferred embodiment comprises: bike roller assembly 102 having base plate 110 and first side 112 having extendable bar 113, second side 116, third side 118, fourth side 120, and inner volume 114. It further comprises top side 130 having a plurality of horizontal roller assemblies 132, plurality of vertical rotators 140, plurality of mount rods 150, and bottom side 160. Bike roller assembly 102 may be made of aluminum 104 which is a sufficiently light, durable material allowing it to be easily transportable for use as desired. Other materials may be used.

Bike roller assembly 102 renders normal bicycle 106 stationary, and able to be utilized indoors to avoid existing outside weather conditions. Mount system 152 allows normal bicycle 106 to be free standing and secure for use as needed, and will accommodate virtually any model of bicycle. It allows a user to pedal normal bicycle 106 at a desired speed, yet remain stationary. Base plate 110 comprises substantially flat plate 111 to allow bike roller assembly 102 to be set on a flat surface, and measures approximately twenty four inches in length by eighteen inches in width for increased operational stability. It is approximately one inch in depth to allow extendable bar 113 to be stored therein. Extendable bar 113 extends outwardly from base plate 110, and alternately retracts back into base plate 110 for storage when not in use. It can be deployed to keep bicycle front tire 170 from making contact with the surface beneath it, keeping that surface clean.

Figure 2:
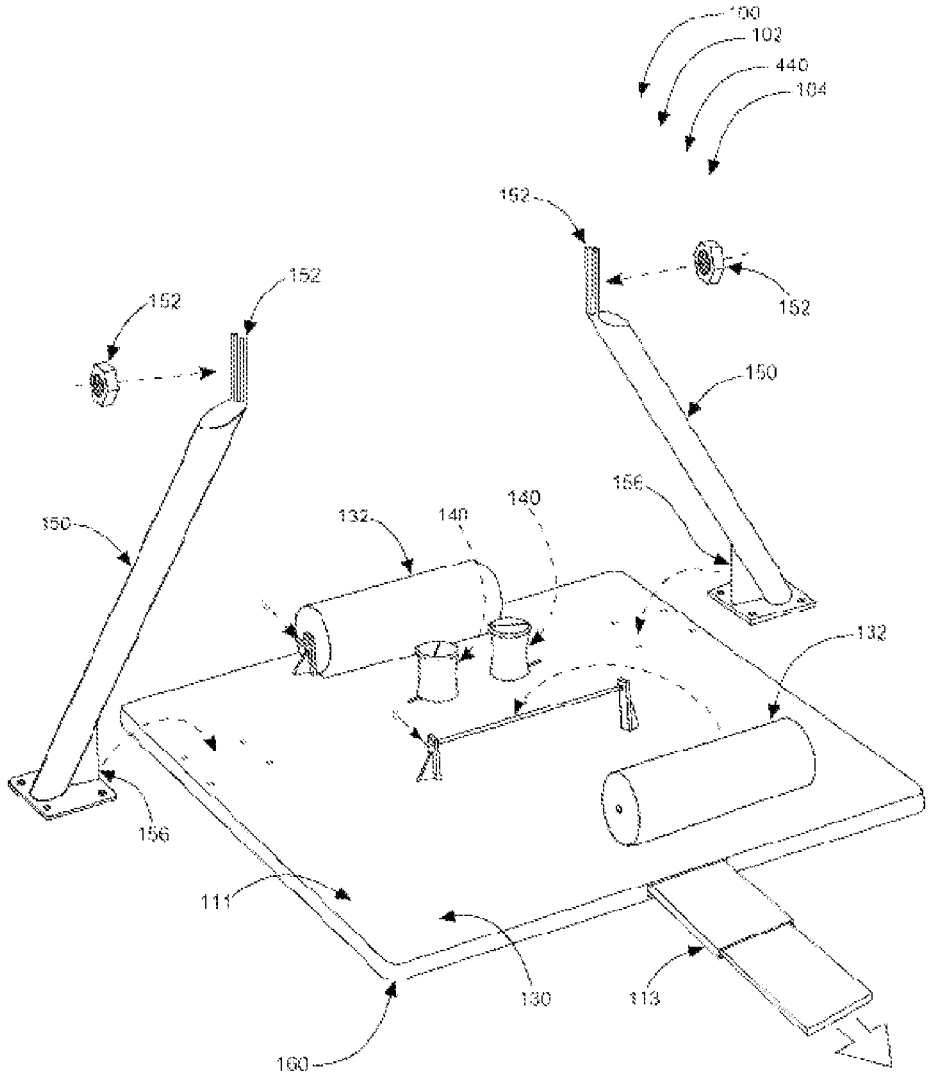
FIG. 2 is an exploded view illustrating a bike roller assembly according to an embodiment of the present invention of FIG. 1.

Referring now to FIG. 2, an exploded view illustrating bike roller assembly 102 according to an embodiment of the present invention.

Top side 130 has plurality of horizontal roller assemblies 132, plurality of vertical rotators 140, and plurality of mount rods 150 mounted thereon. Plurality of horizontal assemblies 132 are evenly spaced apart in a substantially parallel fashion, and rear bicycle tire 133 sits directly on the plurality of horizontal roller assemblies 132 when a normal (conventional) bike 106 is mounted to bike roller assembly 102. Plurality of horizontal roller assemblies 132 are configured to freely rotate three hundred sixty degrees, such that rear bicycle tire 133 is allowed to rotate in a backward motion or a forward motion, and are adjustable to increase pedal resistance, as desired.

Figure 3:
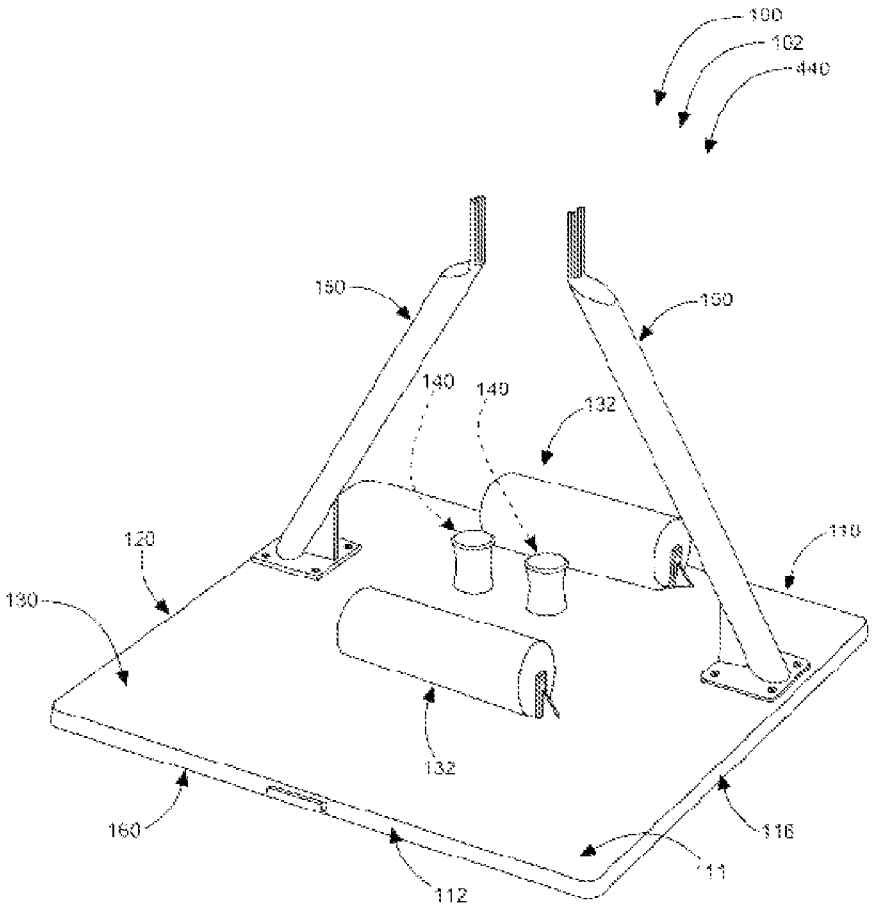
FIG. 3 is another perspective view illustrating the bike roller assembly according to an embodiment of the present invention of FIG. 1.

Referring now to FIG. 3, a perspective view illustrating bike roller assembly 102 according to an embodiment of the present invention.

Plurality of vertical rotators 140 are mounted upon top side 130, and spaced in a manner which allows rear bicycle tire 133 to be placed in between plurality of vertical rotators 140. Rear bicycle tire 133 is vertically fixed between plurality of vertical rotators 140 for increased stability when in an in-use condition 101, and are adjustable to accommodate a variety of tire widths for best use. Plurality of vertical rotators 140 act as a guide for secure placement of rear bicycle tire 133 while in use.

Figure 4:
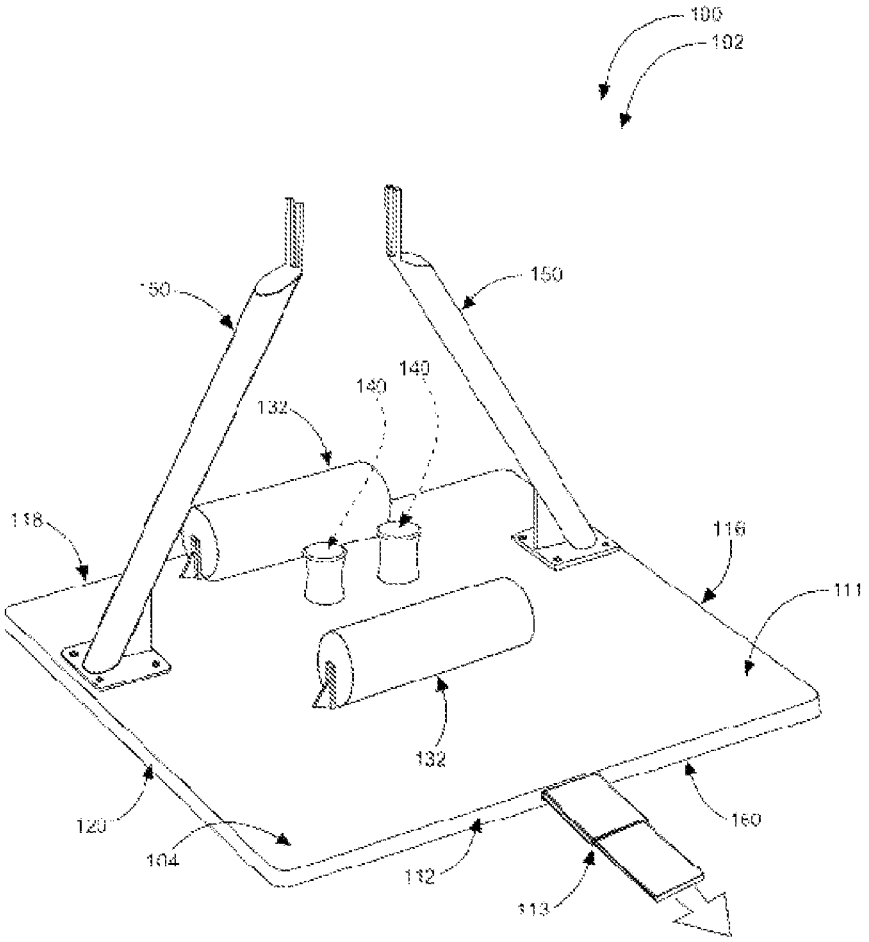
FIG. 4 is yet another perspective view illustrating the bike roller assembly according to an embodiment of the present invention of FIG. 1.

Referring now to FIG. 4, showing another perspective view of bike roller assembly 102 according to an embodiment of the present invention.

Plurality of mount rods 150 are affixed to top side 130 of base plate 110 to allow mounting of bike roller assembly 102 to rear bicycle tire 133 axle. Plurality of mount rods 150 angle towards the center of base plate 110 to allow ease of mounting normal bicycle 106 to bike roller assembly 102 and maintain a low center of gravity for suitable stabilization during use. Plurality of mount rods 150 are attached to rear axle 154 of normal bicycle 106 for use, and preferably have gussets 156 to increase vertical structural stability.

Bike roller system 100 may be sold as kit 440 comprising the following parts: at least one base plate 110 with extendable bar 113 at least one plurality of horizontal roller assemblies 132; at least one plurality of vertical rotators 140; at least one plurality of mount rods 150; and at least one set of user instructions. Bike roller system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different frame securing, base combinations, parts may be sold separately, etc., may be sufficient.

Figure 5:
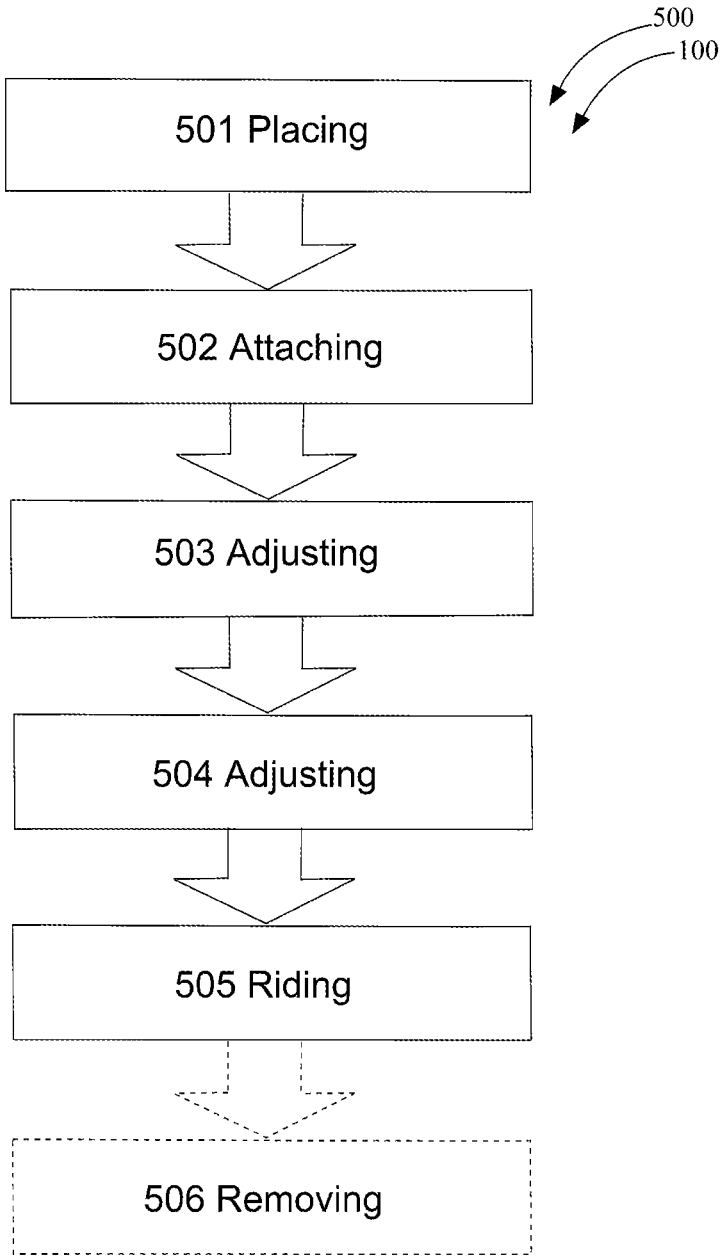
FIG. 5 is a flowchart illustrating a method of use for the bike roller system according to an embodiment of the present invention of FIGS. 1-4.

Referring now to FIG. 5, showing a flowchart illustrating a method of use 500 for bike roller system 100 according to an embodiment of the present invention of FIGS. 1-4.

A method of use 500 preferably comprises step one 501 placing normal bicycle 106 on bike roller assembly 102, step two 502 attaching plurality of mount rods 150 to normal bicycle 106 rear axle 154, step three 503 adjusting plurality of horizontal roller assemblies 132 to desired pedaling resistance, step four 504 adjusting plurality of vertical rotators 140 to correct tire width, and step five 505 riding normal bicycle 106 as desired. The method may further comprise step six 506 removing normal bicycle 106 from bike roller assembly 102 as needed.

It should be noted that step 506 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A bike roller system comprising:

a bike roller assembly having;

a base plate having;

a first side having an extendable bar;

a second side;

a third side;

a fourth side; and an inner volume;

a top side having mounted thereon;

a plurality of horizontal roller assemblies;

a plurality of vertical rotators;

a plurality of mount rods; and a bottom side;

wherein said bike roller system comprises said bike roller assembly;

wherein said bike roller assembly comprises said base plate, said top side, and said bottom side in combination;

wherein said base plate is defined by said first side, said second side, said third side, said fourth side, said top side, said bottom side, and said inner volume in combination;

wherein said inner volume allows said extendable bar to extend outwardly from said base plate, and alternately retract back into said base plate for storage when not in use;

wherein said base plate comprises a substantially flat plate to allow said bike roller assembly to be set on a flat planer surface;

wherein said top side comprises said plurality of horizontal roller assemblies, said plurality of vertical rotators, and said plurality of mount rods in combination;

wherein said plurality of horizontal rollers are mounted on said top side of said base plate, evenly spaced apart in a parallel fashion;

wherein said plurality of horizontal rollers are configured to freely rotate three hundred sixty degrees, such that a rear bicycle tire is allowed to roll-rotate in a backward motion and alternately a forward motion;

wherein said plurality of vertical rotators are mounted upon said top side, and spaced in a manner which allows said rear bicycle tire to be placed in between said plurality of vertical rotators;

wherein said plurality of vertical rotators act as a guide for secure placement of said rear bicycle tire while in use;

wherein said plurality of mount rods are affixed to said top side of said base plate to allow mounting of said bike roller assembly to said rear bicycle tire axle; and wherein said bottom side of said base plate is substantially flat to allow said bike roller assembly to be placed on said flat planer surface for use when desired.

2. The bike roller system of claim 1 wherein said base plate is approximately one inch in depth to allow said extendable bar to be stored therein.

3. The bike roller system of claim 2 wherein said extendable bar is able to be deployed to keep a bicycle front tire from making contact with a surface beneath said bicycle front tire to keep said surface clean.

4. The bike roller system of claim 1 wherein said bike roller assembly renders a normal bicycle stationary and able to be utilized indoors to avoid existing outside weather conditions.

5. The bike roller system of claim 4 wherein a user is able to pedal said normal bicycle at a desired speed yet while said normal bicycle remains stationary.

6. The bike roller system of claim 5 wherein said bike roller assembly mount system allows said normal bicycle to be free standing and secure for use as needed.

7. The bike roller system of claim 2 wherein said base plate measures approximately twenty four inches in length by eighteen inches in width for increased operational stability when in an in use condition.

8. The bike roller system of claim 6 wherein said mount system is universal to allow said bike roller assembly to accommodate virtually any model of said normal bicycle.

9. The bike roller system of claim 8 wherein said plurality of mount rods are removably attached to rear axle of said normal bicycle for use.

10. The bike roller system of claim 9 wherein said plurality of mount rods comprise gussets to increase vertical structural stability.

11. The bike roller system of claim 10 wherein said plurality of mount rods angle towards a center of said base plate to allow ease of mounting said normal bicycle to said bike roller assembly and to maintain a low center of gravity.

12. The bike roller system of claim 1 wherein said rear bicycle tire sits directly on said plurality of horizontal roller assemblies when mounted to said bike roller assembly.

13. The bike roller system of claim 12 wherein said plurality of horizontal roller assemblies are adjustable to increase pedal resistance as desired.

14. The bike roller system of claim 12 wherein said rear bicycle tire is vertically fixed between said plurality of vertical rotators for increased stability when in an in-use condition.

15. The bike roller system of claim 14 wherein said plurality of vertical rotators are able to adjust to accommodate a variety of tire widths for best use.

16. The bike roller system of claim 6 wherein said bike roller assembly comprises aluminum which is a sufficiently light, durable material allowing said bike roller assembly to be easily transportable for use as desired.

17. A bike roller system comprising:

a bike roller assembly having;

a base plate having;

a first side having an extendable bar;

a second side;

a third side;

a fourth side; and an inner volume;

a top side having mounted thereon;

a plurality of horizontal roller assemblies;

a plurality of vertical rotators;

a plurality of mount rods; and a bottom side;

wherein said bike roller system comprises said bike roller assembly;

wherein said bike roller assembly comprises aluminum which is a sufficiently light, durable material allowing said bike roller assembly to be easily transportable for use as desired;

wherein said bike roller assembly comprises said base plate, said top side, and said bottom side in combination;

wherein said bike roller assembly renders a normal bicycle stationary and able to be utilized indoors to avoid existing outside weather conditions;

wherein said bike roller assembly mount system allows said normal bicycle to be free standing and secure for use as needed;

wherein said mount system is universal to allow said bike roller assembly to accommodate virtually any model of said normal bicycle;

wherein a user is able to pedal said normal bicycle at a desired speed yet while said normal bicycle remains stationary;

wherein said base plate is defined by said first side, said second side, said third side, said fourth side, said top side, said bottom side, and said inner volume in combination;

wherein said base plate measures approximately twenty four inches in length by eighteen inches in width for increased operational stability when in an in use condition;

wherein said base plate is approximately one inch in depth to allow said extendable bar to be stored therein;

wherein said inner volume allows said extendable bar to extend outwardly from said base plate, and alternately retract back into said base plate for storage when not in use;

wherein said extendable bar is able to be deployed to keep a bicycle front tire from making contact with a surface beneath said bicycle front tire to keep said surface clean;

wherein said base plate comprises a substantially flat plate to allow said bike roller assembly to be set on a flat planer surface;

wherein said top side comprises said plurality of horizontal roller assemblies, said plurality of vertical rotators, and said plurality of mount rods in combination;

wherein said plurality of horizontal rollers are mounted on said top side of said base plate, evenly spaced apart in a parallel fashion;

wherein said rear bicycle tire sits directly on said plurality of horizontal roller assemblies when mounted to said bike roller assembly;

wherein said plurality of horizontal rollers are configured to freely rotate three hundred sixty degrees, such that a rear bicycle tire is allowed to roll-rotate in a backward motion and alternately a forward motion;

wherein said plurality of horizontal roller assemblies are adjustable to increase pedal resistance as desired;

wherein said plurality of vertical rotators are mounted upon said top side, and spaced in a manner which allows said rear bicycle tire to be placed in between said plurality of vertical rotators;

wherein said rear bicycle tire is vertically fixed between said plurality of vertical rotators for increased stability when in an in-use condition;

wherein said plurality of vertical rotators are able to adjust to accommodate a variety of tire widths for best use;

wherein said plurality of vertical rotators act as a guide for secure placement of said rear bicycle tire while in use;

wherein said plurality of mount rods are affixed to said top side of said base plate to allow mounting of said bike roller assembly to said rear bicycle tire axle;

wherein said plurality of mount rods angle towards a center of said base plate to allow ease of mounting said normal bicycle to said bike roller assembly and to maintain a low center of gravity;

wherein said plurality of mount rods comprise gussets to increase vertical structural stability;

wherein said plurality of mount rods are removably attached to rear axle of said normal bicycle for use; and wherein said bottom side of said base plate is substantially flat to allow said bike roller assembly to be placed on said flat planer surface for use when desired.

18. The system of claim 17 further comprising a kit including: at least one said base plate, at least one said plurality of horizontal roller assemblies, at least one said plurality of vertical rotators, at least one said plurality of mount rods, and at least one set of user instructions for use.

19. A method of using a bike roller system comprising the steps of:

placing a normal bicycle on a bike roller assembly, attaching a plurality of mount rods to said normal bicycle rear axle, adjusting a plurality of horizontal roller assemblies to desired pedaling resistance, adjusting a plurality of vertical rotators to correct tire width, and riding said normal bicycle as desired.

20. The method of claim 19 may further comprise the step of: removing said normal bicycle from said bike roller assembly as needed.

* * * * *